US005823111A

United States Patent [19]

McManamon

[11] Patent Number: 5,823,111

[45] Date of Patent: Oct. 20, 1998

[54] INK SUPPLY MEANS FOR A PRINTING MACHINE

[76] Inventor: David Edward McManamon, Walker Lane, Fulwood, Preston, England

[21] Appl. No.: 702,714

[22] PCT Filed: Mar. 8, 1995

[86] PCT No.: PCT/GB95/00533

§ 371 Date: Nov. 5, 1996

§ 102(e) Date: Nov. 5, 1996

[87] PCT Pub. No.: WO95/24315

PCT Pub. Date: Sep. 14, 1995

[30] Foreign Application Priority Data

Mar. 8, 1994 [GB] United Kingdom ..... 9404455

[51] Int. Cl.[6] ..... B41F 31/02; B41F 31/03

[52] U.S. Cl. ..... 101/365; 101/363; 101/350.1; 101/207; 101/210

[58] Field of Search ..... 101/366, 365, 101/207, 208, 210, 363, 350.1; 118/259; 427/428

[56] References Cited

U.S. PATENT DOCUMENTS

| | | | |
|---|---|---|---|
| 2,275,062 | 3/1942 | Lathey | 101/170 |
| 3,106,480 | 10/1963 | Baker | 101/210 |
| 4,263,848 | 4/1981 | Matalia et al. | 101/363 |
| 4,844,002 | 7/1989 | Yasui et al. | 118/259 |
| 5,005,476 | 4/1991 | Kobler | 101/363 |
| 5,027,706 | 7/1991 | Niemiro et al. | 101/366 |

FOREIGN PATENT DOCUMENTS

| | | | |
|---|---|---|---|
| 523989 | 1/1993 | European Pat. Off. . | |
| 2622508 | 5/1989 | France | 101/366 |
| 24345 | 7/1915 | United Kingdom . | |
| 935351 | 8/1963 | United Kingdom . | |

*Primary Examiner*—Edgar S. Burr
*Assistant Examiner*—Daniel J. Colilla
*Attorney, Agent, or Firm*—Townsend and Townsend and Crew LLP

[57] ABSTRACT

An ink supply unit for a receiving roller of a printing machine. The ink supply unit includes an ink rail mounted in close proximity to the surface of the receiving roller, and a plurality of ink reservoirs mounted one above the other in the ink rail that discharge differently colored inks in accordance with the printing requirements onto the surface of the receiving roller through a valve mechanism. Wiper rollers are mounted adjacent to the surface of the receiving roller to wipe the surface thereof to reduce ink wastage due to misting or the like. The inks are introduced onto the surface of the receiving roller and are mixed to form the required color for printing by the combined action of the wiper rollers and a roller train that links the receiving roller and the print roller in the printing machine.

6 Claims, 2 Drawing Sheets

INK SUPPLY MEANS FOR A PRINTING MACHINE

BACKGROUND OF THE INVENTION

1. Field of the Invention

This invention relates to improvements in or relating to ink supply means for a printing machine and more particularly to an ink supply means which is capable of supplying at least three primary colored inks to a print roller surface in such a manner that they are mixed on the roller surface to form a desired color of ink for printing.

2. Description of the Prior Art

Conventionally, ink supply means in a printing machine are arranged so as to supply a single color of ink to a print roller. If it is desired to change the color of ink for printing, usually the machine has to be stopped, the ink supply changed, and the printing roller cleaned. Of course, this procedure is time-consuming and because the printing machine is stopped, printing time is increased. Furthermore, since it is not possible to change ink color without the necessity for the above actions to be taken, printing versatility is restricted. It is an object of the present invention to provide a more versatile ink supply means wherein at least two different colored inks, particularly two or three primary colors, can be supplied in predetermined relative quantities for mixing prior to application to the surface of the print roller to give any desired color.

SUMMARY OF THE INVENTION

According to the present invention, there is provided an ink supply means for a printing machine comprising an ink rail mounted so as to extend generally longitudinally of a receiving roller of the machine, and wiper rollers mounted adjacent a surface of the receiving roller to wipe a surface thereof. The ink rail comprises at least two discrete ink storage means connected to respective ink outlets in a face of the rail adjacent a surface of the receiving roller and valve means associated with each outlet to regulate the flow of ink through each outlet. The receiving roller is linked to a print roller via a roller train. The inks are mixed by the action of the wiper rollers and passage of the ink between rollers of the roller train.

With this arrangement it is possible to provide an ink supply means which is more versatile in use, and which gives rise to an increased number of printing possibilities.

Preferably the ink rail has a generally curved end face which, in use, is mounted in close proximity to the surface of the receiving roller and generally conforms to the outer circumferential surface of the roller in order to reduce ink wastage.

Preferably the ink storage means are disposed one above the other in the ink rail in order to best utilize the available space in the rail.

Preferably a supply of ink from each reservoir through each respective outlet is controlled by a solenoid-operated valve means under the control of a central control unit. The central control unit may be microprocessor-based.

Preferably three ink storage means are provided, respective ones of which store inks colored in the three primary colors, namely Cyan, Magenta and Yellow.

DETAILED DESCRIPTION OF THE PREFERRED EMBODIMENTS

Figure 1:
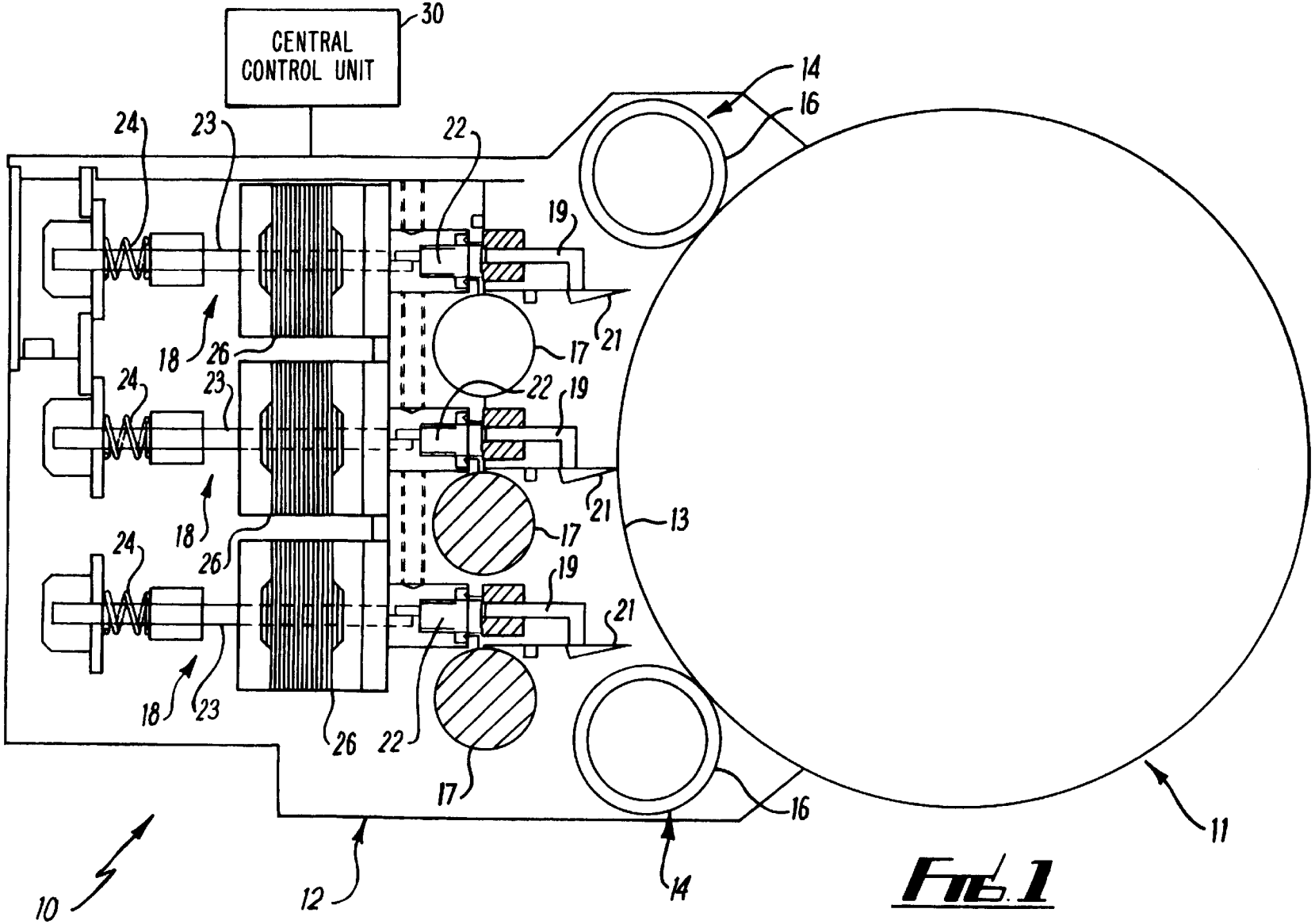
FIG. 1 shows a diagrammatic side view of one form of ink supply means according to the present invention.

Referring now to FIG. 1, there is shown an ink supply unit 10 for a receiving roller 11 of a printing machine.

The ink supply unit 10 comprises an ink rail 12 having a generally concave end face 13 which conforms generally with the outer circumferential surface of the receiving roller 11. The ink rail 12 is mounted in close proximity to the surface of the receiving roller 11 with a gap of 0.002–0.012" (0.00508–0.03048 mm) therebetween in order to prevent ink wastage. Wiper rollers 14 of the kind described in my co-pending UK Application No. 9311230.8 are mounted at a top and a bottom of the ink rail 12 adjacent the concave surface 13 and are disposed such that the outer circumferential surface 16 of each roller 14 is spaced by 0.004–0.010" (0.01016–0.0254 mm) from the outer surface of the receiving roller 11. The wiper rollers 14 act to further reduce ink wastage by ensuring a uniform layer of ink is formed on the outer surface of the roller 11, thereby preventing misting, and also assist in the mixing of the inks applied to the surface of the roller 11.

Ink reservoirs 17 are provided on the ink rail 12 and extend substantially the entire longitudinal length thereof. In the embodiment shown in the drawings, three such reservoirs 17 are shown mounted one above the other. However, it will be appreciated that as many ink reservoirs can be provided as desired or as necessary, the number only being limited by any restriction on the dimensions of the ink rail 12.

Each ink reservoir 17 has associated therewith a solenoid-operated valve mechanism 18 which controls flow of ink from the reservoir 17 through a feed passage 19 to an outlet 21 adjacent the surface of the receiving roller 11. Each valve mechanism 18 comprises a valve head 22 mounted on a shaft 23 which is movable away from the roller 11 against the resistance of a biasing spring 24. The shaft 23 extends through the interior of an electromagnet 26 such that upon actuation of the electromagnet 26, the shaft 23 moves away from the roller 11 against the bias of the biasing spring 24 moving the valve head 22 away from the respective feed passage 19, thereby allowing ink to flow from the reservoir 17 to the surface of the roller 11. The actuation of the electromagnet 26 can be under the control of a central control unit 30 which may be microprocessor-based, and thus the supply of ink from the reservoirs 17 to the surface of the roller 11 can be controlled very accurately.

Figure 2:
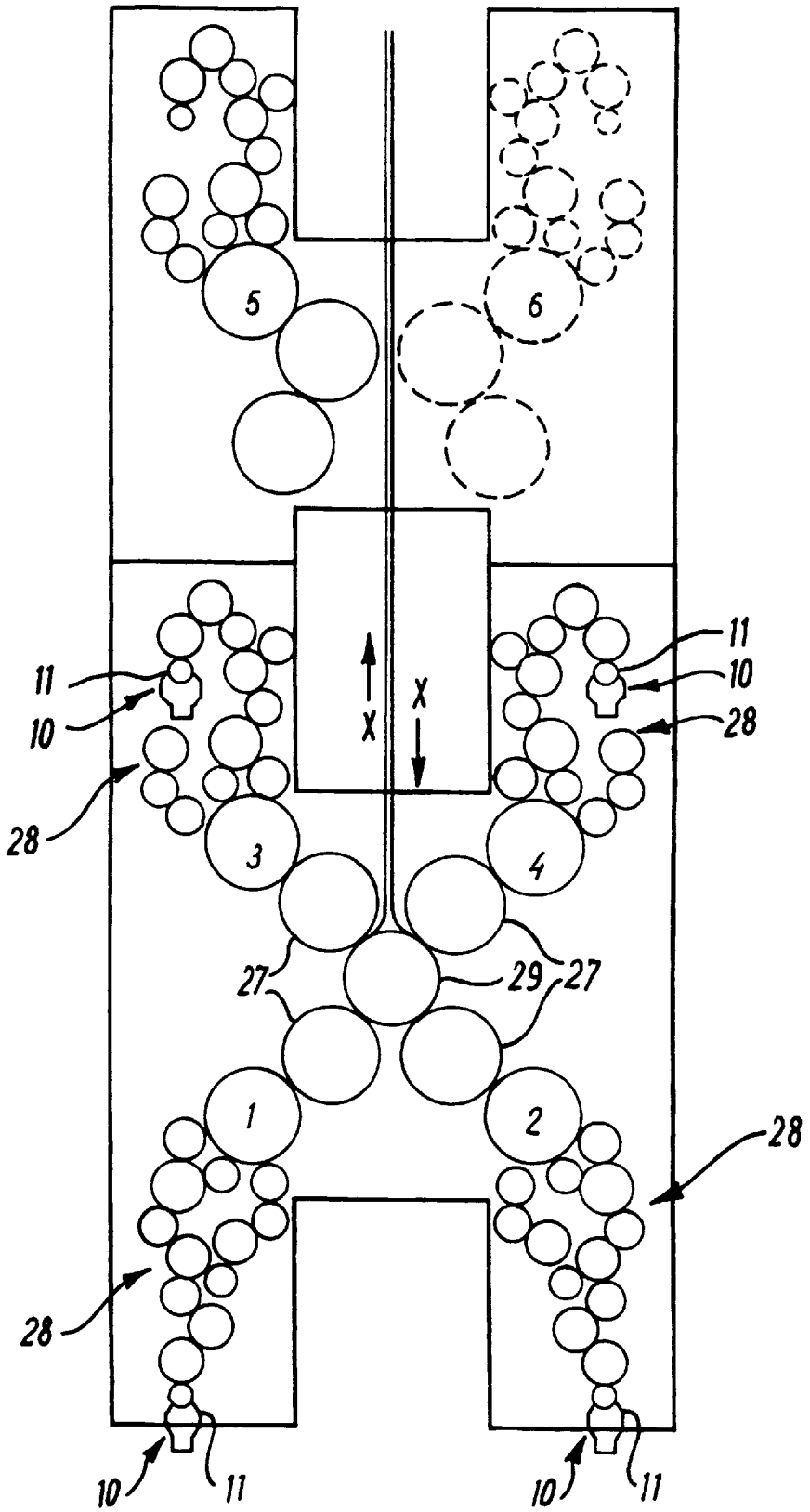
FIG. 2 shows a diagrammatic plan view of a conventional printing machine incorporating the ink supply means of FIG. 1.

FIG. 2 shows a schematic representation of the layout of a typical printing machine, for example one used in the newspaper industry. An ink supply unit 10 of FIG. 1 is mounted adjacent a receiving roller which is linked to a print roller 27 by a respective roller train 28. The print rollers 27 are mounted in close proximity to a paper mounting roller 29. The path of the paper through the printing machine is indicated by arrow X and as the paper passes around the mounting roller 29, the ink is applied to the paper by each print roller 27. In a conventional printing machine, each print roller would apply a single color ink only to the paper (chosen usually from Cyan, Magenta or Yellow). However, with the present arrangement, the color of ink to be applied to the paper by each print roller can be changed easily and quickly in a manner to be described hereinafter.

The ink supply unit 10 associated with each receiving roller 11 can, as described above, under the control of central control unit 30, apply any predetermined quantities of the inks contained in the reservoirs 17 to the surface of the receiving roller 11. In the present embodiment, the three primary colors (Cyan, Magenta and Yellow) are contained in three reservoirs. However, any number of reservoirs can be provided as desired or as appropriate. Thus, for example, one or more additional reservoirs can be provided which can contain one or more additional colors, for example Black, Gold, Silver, etc.

Thus, under the control of the control unit, predetermined quantities of ink for each reservoir are applied to the surface of each roller 11. The mixing of the different colored inks to form the ink of the desired color is initiated by the action of wiper rollers 14. As described in my co-pending application described above, these rollers are driven so that the circumferential surfaces move in a direction opposite to the surface of the roller 11, and therefore act to wipe the surface of the roller. Therefore, the inks applied to the surface of the roller 11 in the vicinity of outlet 21 are mixed as a fine uniform layer of ink is formed on the surface of the roller 11 under the action of the wiper rollers 14. Mixing of the inks is continued as the ink passes down each roller train 28 from the roller 11 to each print roller 29. The transfer of ink between each roller of the train ensures that the mixing of the inks is thorough by the time the inks are transferred to the print roller 27 for application to the paper during printing.

It is of course to be appreciated that using a conventional printing machine of the type shown in FIG. 2 and with each ink supply unit 10 being controlled by the control unit independently of all the other supply units, the printing possibilities are increased significantly and therefore the versatility is increased. Thus, for example, each ink supply unit 10 can supply a different mixed color ink or, alternatively, each ink supply unit can supply the identical single color ink. Furthermore, many variations on this are permitted and will be readily appreciated by the skilled reader.

It is of course to be understood that the present invention is not intended to be restricted to the details of the above embodiment, which are described by way of example only.

What is claimed is:

1. Ink supply means for a printing machine having a receiver roller, a roller train and a print roller, said receiving roller being linked to said print roller via said roller train, said ink supply means comprising an ink rail mounted so as to extend generally longitudinally of a receiving roller of the machine, wiper rollers mounted adjacent a surface of the receiving roller to wipe a surface thereof, said ink rail comprising at least two discrete ink storage means connected to respective ink outlets in a face of said rail adjacent a surface of the receiving roller and valve means associated with each said outlet to regulate flow of ink through each said outlet, said inks being mixed by the action of said wiper rollers and passage of the ink between rollers of said roller train.

2. Ink supply means according to claim 1 wherein said ink rail has a generally curved end face which, in use, is mounted in close proximity to the surface of the receiving roller and generally conforms to the outer circumferential surface of the roller in order to reduce ink wastage.

3. Ink supply means according to claim 1 wherein when said rail is mounted substantially horizontally, said ink storage means are disposed one above the other in said ink rail in order to best utilize the available space in the rail.

4. Ink supply means according to claim 1 further comprising a solenoid-operated valve associated with each ink storage means and a central control unit, wherein the supply of ink from each ink storage means through each respective outlet is controlled by said solenoid-operated valve under the control of said central control unit.

5. Ink supply means according to claim 4 wherein the central control unit is microprocessor-based.

6. Ink supply means according to claim 1 wherein three ink storage means are provided for storing inks colored in the three primary colors Cyan, Magenta and Yellow, respectively.

* * * * *